United States Patent [19]

Ishimoto et al.

[11] 4,271,784

[45] Jun. 9, 1981

[54] APPARATUS FOR DISCHARGING A FATIGUED DEVELOPING AGENT IN A MAGNETIC BRUSH DEVELOPING DEVICE

[75] Inventors: Osamu Ishimoto, Hachioji; Hiroshi Tsuda, Mitaka; Kiyoshi Miyashita, Hachioji, all of Japan

[73] Assignee: Olympus Optical Co., Ltd., Tokyo, Japan

[21] Appl. No.: 71,022

[22] Filed: Aug. 29, 1979

[51] Int. Cl.[3] ..... G03G 15/09; G03G 21/00

[52] U.S. Cl. ..... 118/652; 15/256.51; 101/13; 355/3 DD

[58] Field of Search ..... 118/652, 203; 15/1.5 R, 15/1.5 A, 256.51; 355/3 DD, 3 DR, 15; 430/122; 101/13, 425; 427/13, 25

[56] References Cited

U.S. PATENT DOCUMENTS

| | | | |
|---|---|---|---|
| 3,883,242 | 5/1975 | Takahashi et al. | 355/3 DR |
| 3,966,316 | 6/1976 | Pfeifer et al. | 355/3 DR |
| 4,076,402 | 2/1978 | Kanno et al. | 355/3 DR |

*Primary Examiner*—Morris Kaplan

*Attorney, Agent, or Firm*—Haseltine and Lake

[57] ABSTRACT

An apparatus for discharging a used and fatigued developing agent from a magnetic brush developing device installed in a main body of a copying machine, which developing device has a housing with an opening at a position which is opposed to a charge retentive member such as a photosensitive drum and a record paper, a sleeve made of non-magnetic material is rotatably arranged in the housing such that it exposes the outside of the housing through the opening and a magnet assembly arranged in a space within the sleeve. First and second shafts are secured to the respective sides of the magnet assembly, a third shaft secured to the sleeve at a side which is opposed to that of the magnet assembly to which the first shaft is connected, first and second bearing members are arranged between the first and second shafts and the sleeve, respectively, and a manually operable handle is secured to either one of said second and third shafts. Means guide the housing to a position removed from the main body and a scraper is then detachably secured to the housing in operative association with the sleeve. The handle is operated whereby the magnetic brush discharges said fatigued agent through the scraper and into a receiver.

13 Claims, 13 Drawing Figures

APPARATUS FOR DISCHARGING A FATIGUED DEVELOPING AGENT IN A MAGNETIC BRUSH DEVELOPING DEVICE

BACKGROUND OF THE INVENTION

The present invention relates to an apparatus for discharging or removing a developing agent from a magnetic brush developing device for use in an electrophotographic copying or printing machine.

In the magnetic brush developing device, use is made of a two component developing agent consisting of carriers made of magnetic material and toners made of thermoplastic resin of low melting point having mixed with dye or pigment such as carbon black. Such a two component developing agent is stirred and mixed in the developing device and the toners are charged due to friction between the toners and carriers to a polarity opposite to that of an electrostatic charge image on a charge retentive member such as a photosensitive drum.

Usually the magnetic brush developing device comprises a housing having an opening at a position which is opposed to the charge retentive member, a sleeve made of non-magnetic material is arranged rotatably in the housing at such a position that a part of the sleeve surface exposes the outside of the housing through the opening and a magnet assembly arranged fixedly in a space within the sleeve. In such a device, when the sleeve is rotated in a given direction, the developing agent attracted onto the sleeve surface is transported to the opening and is brought into contact with a surface of the charge retentive member through the opening. Also, in such a developing device since the toners are consumed each time the developing operation is effected, the developing device is provided with a hopper for containing toners and a mechanism for supplementing a given amount of toners from the hopper so as to keep always a toner concentration of the developing agent to a desired value. On the contrary, the magnetic carriers are not consumed in the developing operation, but are repeatedly used. However, the carriers are fatigued mechanically and physically due to an agitation, secular variation, etc., and thus should be exchanged by new carriers after the developing device has been used for a predetermined time period or a predetermined number of developing operation have been effected. In order to exchange the used and fatigued carriers by new ones, the fatigued carriers must be first discharged or removed from the developing device together with toner particles and then a new developing agent consisting of new carriers and toners must be introduced into the developing device.

Heretofore, there have been proposed various kinds of apparatus for discharging the fatigued developing agent from the magnetic brush developing device. For instance, in Japanese Utility Model Publication No. 50,533/76 there is disclosed a discharging apparatus in which a box having a scraping edge is detachably secured in a developing device in such a manner that the scraping edge is made in contact with a rotatably arranged sleeve surface. When the sleeve is rotated, the developing agent attracted onto the sleeve surface is fed to the scraping edge and is scraped off the sleeve. The developing agent thus scraped is collected in the box. Then, the box is removed from the developing device. In such an apparatus since a magnet assembly of the magnetic brush developing device is fixedly arranged during the discharging operation and thus the developing agent is fed only due to a frictional force between the developing agent and sleeve surface, the agent is fed or transported to the scraping edge of box only with a very small force. Further, in this known apparatus during the discharging operation the sleeve is rotated in a direction which is same as that during the normal developing operation. As is well known the magnetic brush developing device comprises a doctor blade for limiting an amount of developing agent attracted onto the sleeve surface. In the known discharging apparatus since the scraping edge is arranged at a downstream side with respect to the doctor blade (when viewing in the rotating direction of sleeve), an amount of the developing agent fed to the scraping edge is limited by the doctor blade. Therefore, an efficiency of the discharging operation is very low and thus the discharging operation is a quite time consuming one. Further, when an amount of developing agent remained in the developing device becomes small near the end of the discharging operation, the agent attracted onto the sleeve near the poles of the magnet does not move together with the sleeve, but is remained near the poles. This results in that a part of the developing agent is always remained in the developing device without being discharged.

Further, in the known discharging apparatus, the box for receiving the developing agent has to be installed in a space within a housing of the developing device and thus the developing agent is liable to spread outside the developing device and moreover operator's hands might be stained with the developing agent.

SUMMARY OF THE INVENTION

The present invention has for its object to provide a novel and useful apparatus for discharging a used and fatigued developing agent from a magnetic brush developing device, which apparatus can avoid the above mentioned various drawbacks of the known discharging apparatus and can effect the discharging operation in a very efficient and easy manner.

It is another object of the invention to provide a developer discharging apparatus in which a non-magnetic sleeve and a permanent magnet assembly of the magnetic brush developing device can be rotated together with each other in a direction opposite to that for a usual developing operation.

It is still another object of the invention to provide a developing agent discharging device in which the magnet assembly can be automatically locked in position after the discharging operation has been completed.

It is still another object of the invention to provide a developer discharging apparatus in which a box of bag for collecting a discharged developer agent can be easily set outside a housing of a developing device.

According to the invention, an apparatus for discharging a used and fatigued developing agent from a magnetic brush developing device is installed in an electro-photographic copying machine, which developing device comprises a housing having formed therein an opening at a position which is opposed to a charge retentive member for retaining an electrostatic charge image to be developed, a sleeve made of non-magnetic material and arranged in the housing at such a position that it exposes the outside of the housing through said opening and a magnet assembly arranged inside the sleeve, one of said sleeve and magnet assembly being arranged rotatably in a given direction, comprises means for rotating manually the sleeve and the magnet assembly together with each other so as to transport the developing agent attracted on the sleeve surface to a position at the opening under such a condition that the developing device can be pulled out of a main body of the copying machine; scraping means secured detachably to the housing at said opening and having a scraping edge which is made in contact with the sleeve surface through the opening so as to scrape the transported developing agent off the sleeve; and receptacle means are arranged below the scraping means for receiving the discharged developing agent through the opening.

In a preferred embodiment of the discharging apparatus according to the invention, said manually rotating means comprises first and second shafts arranged coaxially with the sleeve and connected to respective sides of the magnet assembly, a third shaft arranged coaxially with the sleeve and connected to the sleeve at its one side which faces to the side of the magnet assembly to which said first shaft is secured, said second and third shafts being rotatably journaled to the housing of developing device, a first bearing member arranged between the first shaft and the sleeve, a second bearing member arranged between the second shaft and the sleeve and a manually operable member connected to one of said second and third shafts for rotating manually one of the magnet assembly and the sleeve, while the other of the sleeve and the magnet assembly is made rotatable due to a magnetic force caused between the magnet assembly and magnetic particles in the developing agent as well as a frictional force between the developing agent and the sleeve surface.

The preferred embodiment according to the invention is used with a magnetic brush developing device in which the magnet assembly is retained at a given rotational position during the normal developing operation, the manually rotating means further comprises a mechanism arranged between said second shaft and the housing of the developing device for locking automatically the magnet assembly into a given rotational position.

DESCRIPTION OF THE PREFERRED EMBODIMENTS

Figure 1:
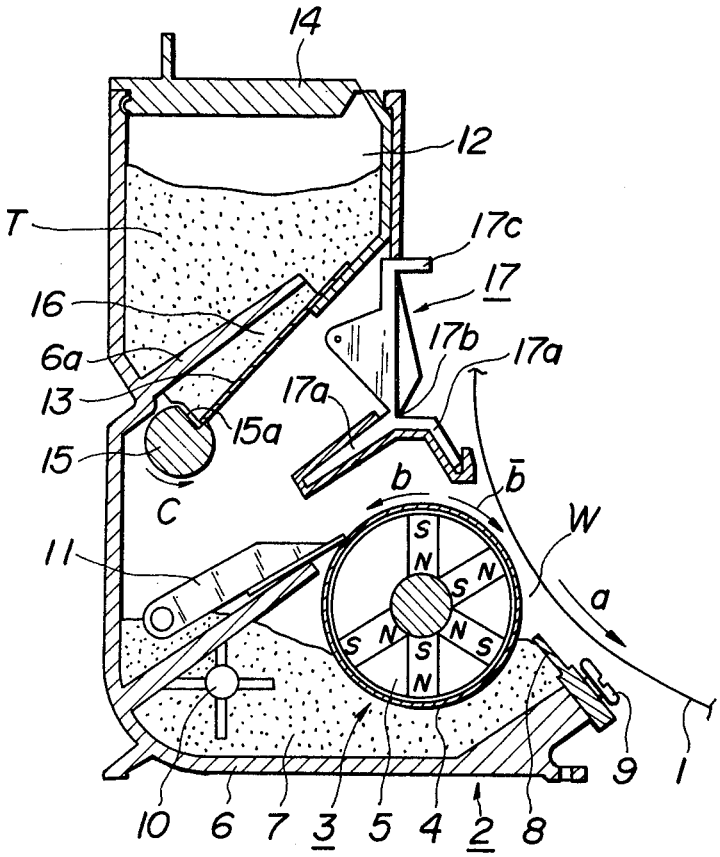
FIG. 1 is a cross-sectional view showing an embodiment of a magnetic brush developing device to which a developing agent discharging apparatus according to the invention is applied.

FIG. 1 is a cross section for showing an embodiment of a magnetic brush developing device to which the present invention is applied. In this embodiment the developing device is used for an electrophotographic copying machine. It is apparent that a similar device may be used for an electrophotographic printing machine. An electrostatic charge retentive member 1 is formed as a drum which has a surface layer made of insulating material or photoconductive material and is rotatably journaled to a main body of the copying machine (not shown) in a direction shown by an arrow a. By means of a known electrophotography an electrostatic charge image may be formed on the surface layer of the drum 1.

A developing device generally denoted by a reference numeral 2 is removably installed in the main body of the copying machine and comprises a magnetic brush assembly 3 including a tubular sleeve 4 made of non-magnetic material and a permanent magnet assembly 5 arranged inside the sleeve. According to the invention the magnet assembly 5 as well as the sleeve 4 are rotatably secured to a housing 6 of the developing device. The magnetic brush assembly 3 is arranged in the housing 6 at a position near an opening W formed in the housing 6, so that a part of the sleeve 4 exposes the outside of the housing through said opening W. During the developing operation the sleeve 4 is rotated in a direction shown by an arrow b by means of a suitable driving mechanism not shown, but the magnet assembly 5 is fixed at a given rotational position, i.e., a position in which at least one of the poles of the magnet assembly 5 is placed in opposite to the charge retentive member 1. A developing agent 7 consisting of magnetic carriers and toners is stored in the casing 6 and is attracted onto the surface of the sleeve 4 due to a magnetic force of the magnet assembly 5 so as to form a so-called magnetic brush. Under such a condition when the sleeve 4 is rotated in the direction b, the developing agent 7 is fed along the sleeve surface and is made into contact with the surface of charge retentive member 1. In this manner, the electrostatic charge image on the drum 1 is developed with toners. A doctor blade 8 for limiting an amount of agent 7 fed on the sleeve 4, i.e., a height of furs of magnetic brush is secured by screws 9 to a lower edge of the opening W of the housing 6. Near the bottom of the housing 6 there is also rotatably arranged an agitating vane 10 for stirring the agent 7 so as to electrify the toners by friction to a given polarity.

Figure 2:
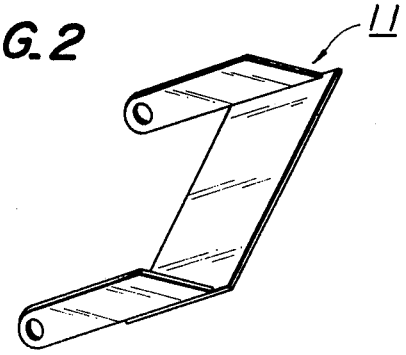
FIG. 2 is a perspective view illustrating an embodiment of a scraping blade member according to the invention.

The developing agent still remaining on the sleeve surface after the developing operation is scraped off the sleeve 4 by means of a scraping blade 11 shown in FIG. 2 which is swingably secured to the housing 6 and is brought into contact with the sleeve surface due to the gravitational force. In order to weaken the magnetically attractive force of the developing agent with respect to the sleeve 4, no pole of the magnet assembly 5 is at a position opposite to the scraping blade 11 as shown in FIG. 1. The developing agent scraped off the sleeve 4 is agitated at the bottom of the housing 6 and is attracted again to the sleeve surface so as to be used repeatedly for a new developing operation.

At an upper portion of the housing 6 there is arranged a hopper 12 for containing toners T to be supplemented to the developing agent 7. The hopper 12 is formed by a part of the housing 6 and a resilient plate 13. An upper opening of the hopper 12 is closed by a lid 14. At a lower opening of the hopper 12 is arranged a toner supplying roller 15 which is rotated at a given velocity in a direction shown by an arrow c in synchronism with the rotation of the sleeve 4. The roller 15 has formed therein a longitudinal recess 15*a* for receiving therein a given amount of toners T in the hopper 12. During the operation a front edge of the resilient plate 13 engages with the recess 15*a*. In this embodiment, in order to prevent the toners in the hopper 12 from falling down into the bottom of the housing 6 through slit-like spaces formed between the inner wall of casing 6 and side edges of the plate 13, the casing 6 is integrally provided with ribs 6*a* having a height of about 5 to 20 mm. Between the ribs and the plate 13 are arranged sheets 16 made of sponge which are cemented to the lower surfaces of ribs. In this manner, a given amount of toners in the recess 15*a* of the roller 15 can be supplied into the developing agent 7 so as to keep a toner concentration of the agent 7 to be a desired value. In this case, any residual toners in the recess 15*a* can be positively taken out of the recess by means of the front edge of resilient plate 13. Since the toners are fine powders, a bridge of toners might be formed above the roller 15. In this embodiment, the resilient plate 13 vibrates each time its front edge engages with the recess 15*a* of the roller 15 and thus said bridge could be broken and the toner particles can be supplemented in a very stable and accurate manner.

Figure 3:
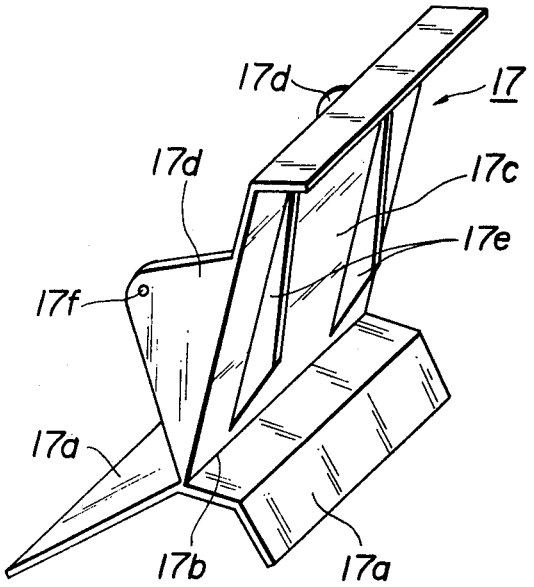
FIG. 3 is a perspective view depicting a lid member for covering an opening of the developing device of FIG. 1 through which a new developing agent can be introduced.

Further, at a middle of the housing 6 there is formed an opening through which a new developing agent can be introduced into the developing device. This opening is selectively closed by a lid 17 illustrated in FIG. 3. The lid 17 is made of plastics such as polypropylene, polyethylene, ABS, etc., and comprises a base portion 17*a* which is secured to the housing 6, a hinge portion 17*b* which has a smaller thickness and a lid portion 17*c* which can be rotated about the hinge portion 17*b*. On inner and outer surfaces of the lid portion 17*c* there are formed reinforcing ribs 17*d* and 17*e* and the inner ribs are provided with depressions 17*f* which constitute a click mechanism in conjunction with projections formed in the housing 6. These portions are formed integrally with each other. A rotational angle of the lid portion 17*c* is limited to a suitable value, preferably 60° by an engagement of the outer ribs 17*e* with the outer base portion 17*a*. Further, in case of introducing a new developing agent the inner ribs 17*d* serve to prevent the agent from overflowing from both sides of the lid portion 17*c*. Moreover, since the lid portion 17*c* is rotated about the hinge portion 17*b* having no space through which the particles might escape the new developing agent does not leak at all through the hinge portion. In this manner, even an unexperienced person can easily introduce the new developing agent into the housing 6 without spilling the agent.

Next, a mechanism for holding the magnetic brush assembly 3 and a mechanism for locking the magnet assembly 5 will be explained with reference to FIGS. 4 and 5.

Figure 4:
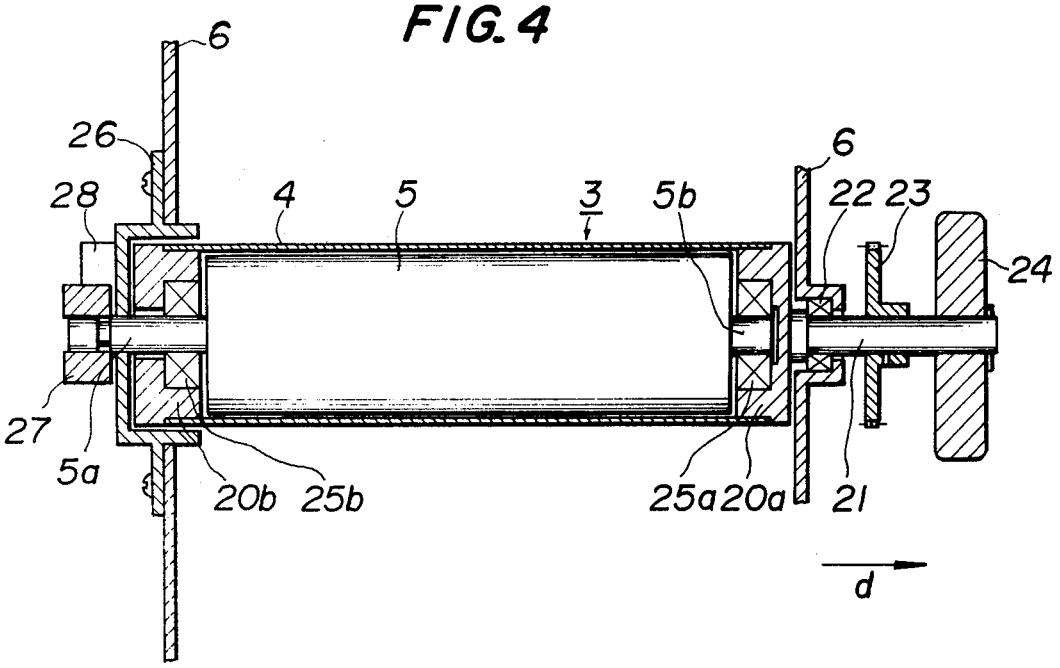
FIG. 4 is a cross section illustrating a magnetic brush assembly of the developing device of FIG. 1.
Figure 5:
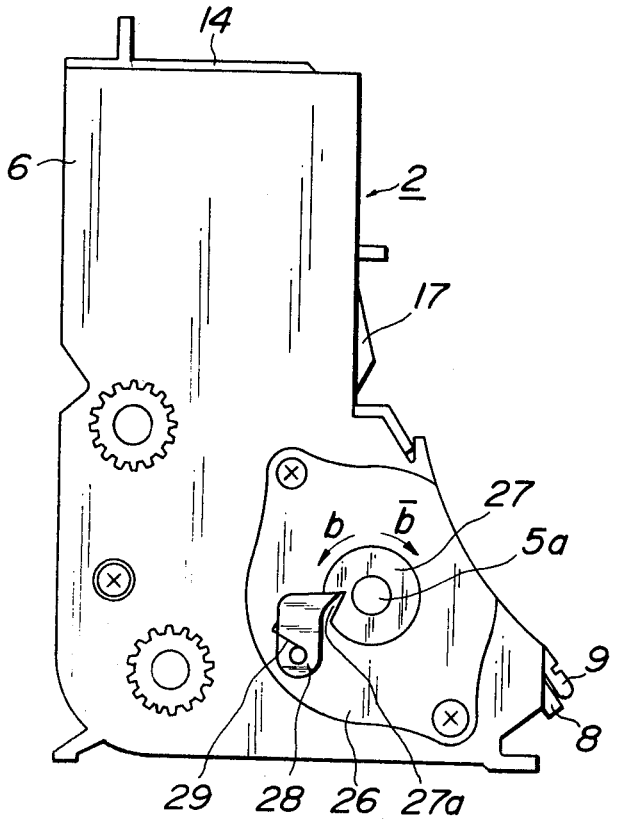
FIG. 5 is a side view of the developing device of FIG. 1.

FIG. 4 is a longitudinal cross section of the magnetic brush assembly 3. At both ends of the non-magnetic sleeve 4 are arranged flanges 20*a* and 20*b* and a driving shaft 21 is secured to the flange 20*a*. The shaft 21 is journaled to the housing 6 by means of a bearing 22. A driving gear 23 for driving the sleeve 4 by means of a suitable driving mechanism (not shown) and a manually operating handle 24 are fixed to the shaft 21. The handle 24 serves to rotate manually the sleeve 4 after the developing device 2 has been pulled out of the main body of copying machine. In this case, the gear 23 is disengaged from the driving mechanism. The magnet assembly 5 is journaled with respect to the sleeve 4 by means of bearings 25*a* and 25*b* installed in the flanges 20*a* and 20*b*, respectively, and shafts 5*a* and 5*b* secured to respective sides of the magnet assembly 5. The shaft 5*a* extends through a supporting plate 26 secured to the housing 6 and a ratchet 27 is secured to a free end of the shaft 5*a*. As illustrated in FIG. 5, the ratchet 27 has formed therein a recess 27*a* which engages with a claw 28 rotatably secured on the outer surface of housing 6. The claw 28 is biased to rotate in the clockwise direction in FIG. 5 by means of a spring 29. Therefore, when the claw 28 engages with the recess 27*a* of ratchet 27 the magnet assembly 5 does not rotate in the direction b, but the magnet assembly 5 can rotate in the opposite direction.

Next, an operation for exchanging the old and fatigued developing agent by a new agent will be explained.

Figure 6:
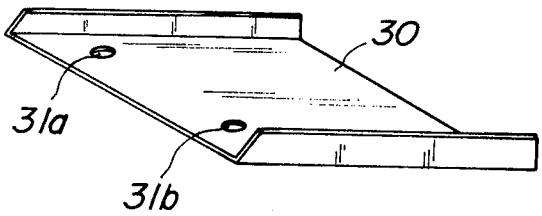
FIG. 6 is a perspective view showing an embodiment of a scraping member according to the invention.
Figure 7:
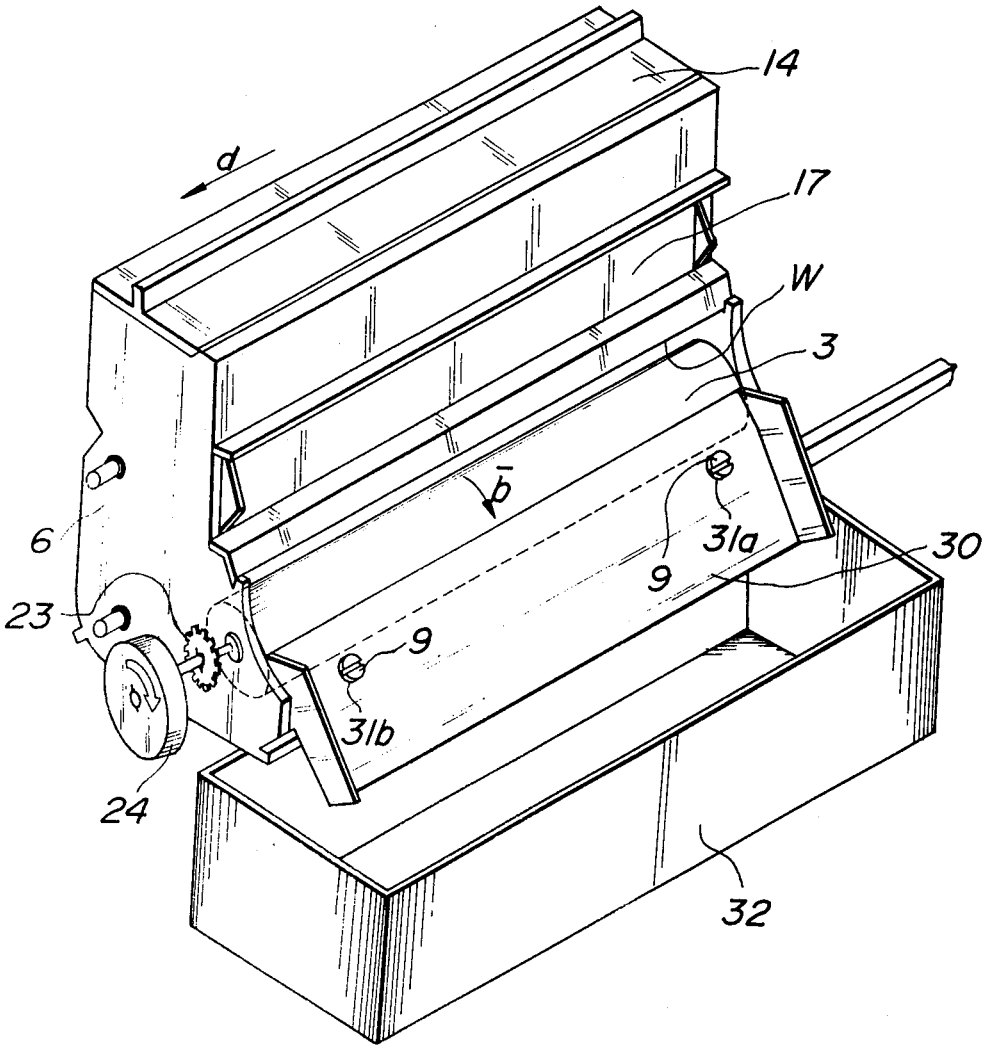
FIG. 7 is a perspective view showing the discharging apparatus according to the invention.

Prior to the discharge of the old agent, a discharging plate 30 shown in FIG. 6 is prepared. The plate 30 is formed generally as a channel and is provided with holes 31*a* and 31*b* which engage with the heads of screws 9 for fixing the doctor blade 8 or bosses provided on the doctor blade. As shown in FIG. 7, when the plate 30 is secured to the heads of screws 9, its scraping edge is made into contact with the surface of the sleeve 4. It should be noted that the plate 30 can be simply secured to the developing device 2 after the device 2 has pulled out of the main body of copying machine in a direction d parallel to an axis of the magnetic brush assembly 3. Then, as illustrated in FIG. 7, a box 32 is placed under the plate 30 and the sleeve 4 is rotated in a direction opposite to the direction $\bar{b}$ by actuating the handle 24. Hereinafter this direction will be denoted as the direction $\bar{b}$. Since the magnetic carriers on the sleeve 4 and the magnet assembly 5 are attracted to each other, when the sleeve 4 is rotated in the direction b, the magnet assembly 5 can rotate also in the direction $\bar{b}$, while the engagement between the ratchet 27 and the claw 28 is released. In this manner, the magnet assembly 5 rotates together with the sleeve 4 in the same direction $\bar{b}$. Therefore, the developing agent 7 to be discharged can be strongly attracted to the sleeve surface not only by the frictional force between the agent and the sleeve, but also by the magnetic force of the magnet assembly 5. Thus, the developing agent 7 can be positively fed on the sleeve surface during the rotation of the sleeve 4 and the magnet assembly 5. The developing agent on the sleeve surface is first brought into a position of the scraping blade 11. As explained above, since this blade 11 can freely rotate the developing agent which is firmly attracted to the sleeve surface is not peeled off the sleeve surface, but can push the scraping blade 11. Therefore, the developing agent on the sleeve surface can pass through the scraping blade 11 and then reach the front edge of the scraping plate 30. Since this plate 30 is firmly secured to the housing 6, the developing agent can be positively peeled off the sleeve surface and is discharged into the box 32 by means of the plate 30.

As explained above, according to the invention, since the magnet assembly 5 is rotated in the direction $\overline{b}$ together with the sleeve 4, the developing agent to be discharged can be attracted to the sleeve surface with a very strong force and thus can be transported positively to the scraping edge of the plate 30. Therefore, the discharging operation can be effected in a very efficient manner and almost all developing agent can be discharged in a very short time.

After the old developing agent has been discharged a new developing agent can be introduced into the developing device 2 with the lid member 17 being opened. Then, the developing device 2 is pushed into the main body of the copying machine after removing the discharging plate 30 and the box 32.

In the known developing device the new developing agent is introduced into the casing from an opening through which the magnetic brush assembly 3 is exposed to the outside. In such a case, the agent will be stuck to the sleeve surface and might clog the opening and thus the introducing operation requires a skill. On the contrary, according to the present embodiment, since the new developing agent can be introduced through another opening provided in the housing 6 and the lid member 17 has several functions as explained above, the new developing agent can be simply introduced into the housing without any particular skill.

During the discharging operation since the magnet assembly 5 is rotated together with the sleeve 4 it is not always assured that the magnet assembly 5 will be stopped at the given position shown in FIG. 1. However, when the sleeve 4 is rotated in the direction b by means of the driving mechanism and gear 23 after the developing device has been installed into the main body the magnet assembly 5 is also rotated in the direction b due to the magnetic force produced between the magnetic carriers and the magnet assembly 5. Thus, the claw 28 will engage with the ratchet 27 within one turn of the magnet assembly 5. In this manner, the magnet assembly 5 can be automatically locked at the given rotational position.

Figure 8:
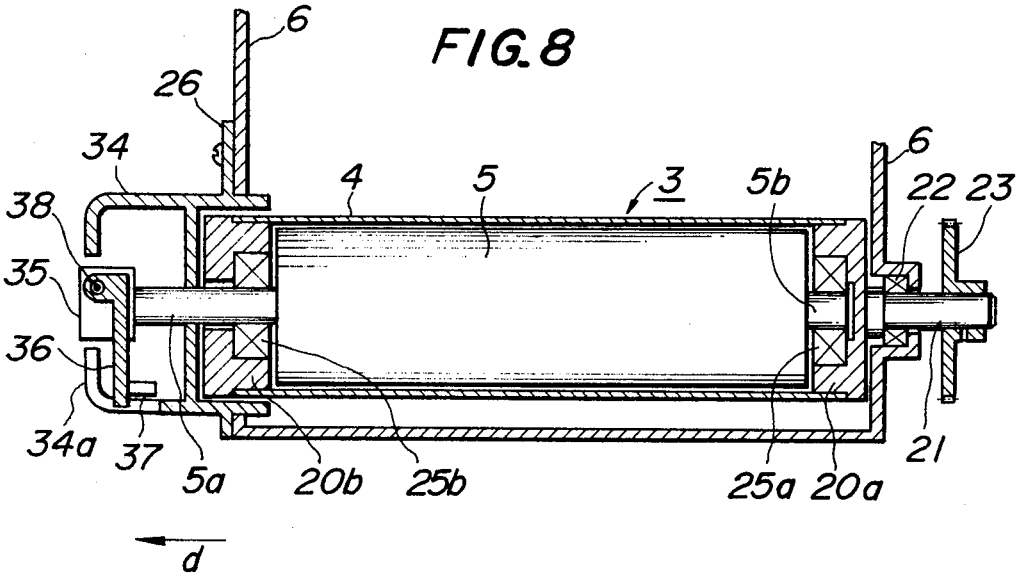
FIG. 8 is a cross section depicting a magnetic brush assembly of another embodiment of the discharging apparatus according to the invention.
Figure 9:
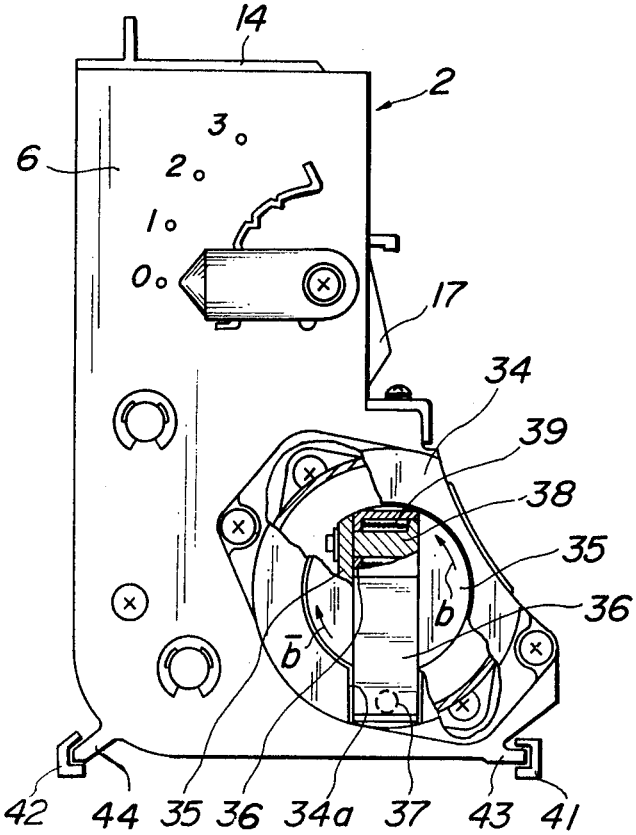
FIG. 9 is a side view showing the developing device of FIG. 8.
Figure 10:
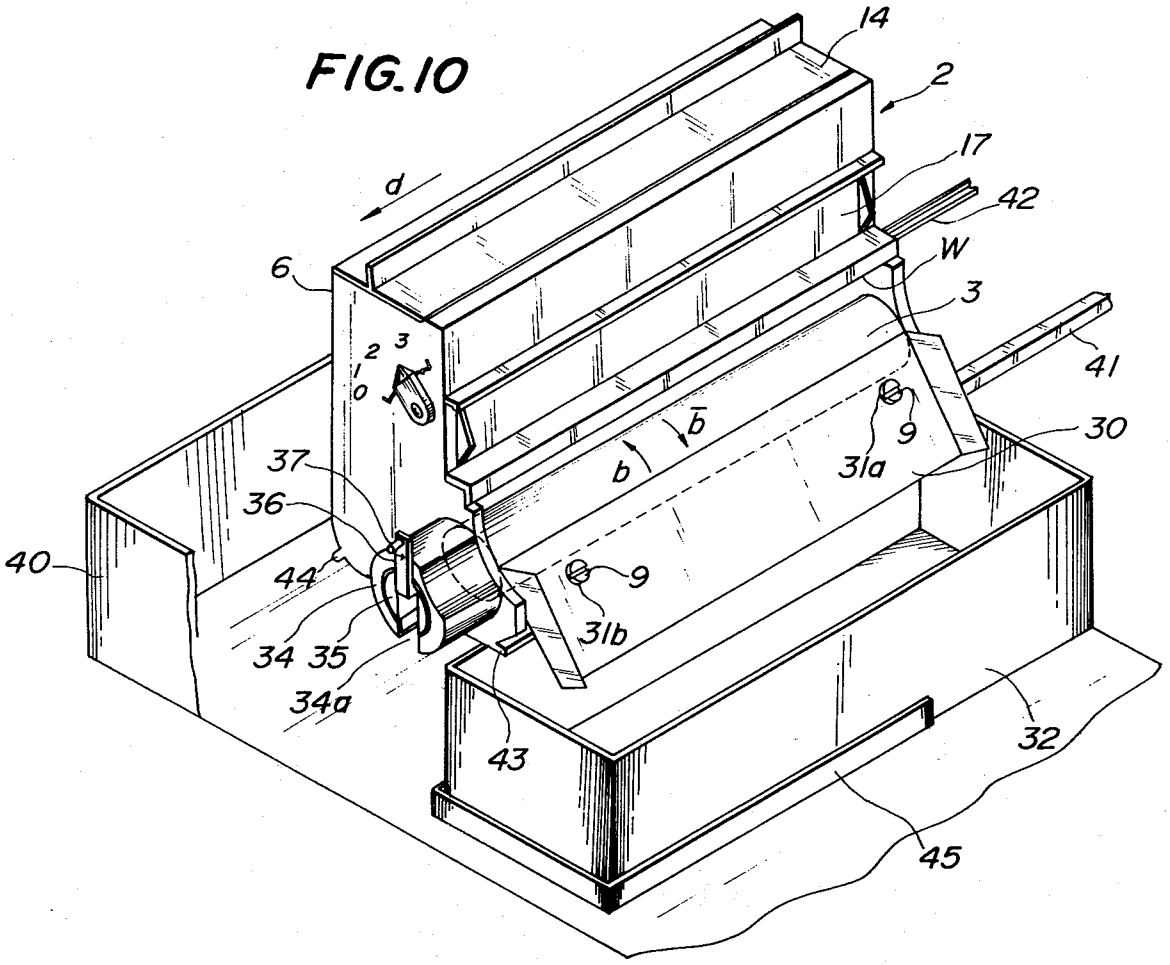
FIG. 10 is a perspective view illustrating the whole construction of the discharge apparatus.

FIGS. 8, 9 and 10 show another embodiment of the developing agent discharging apparatus according to the invention. In this embodiment, same parts as those of the previous embodiment are denoted by the same reference numerals. The mechanism for supporting rotatably a magnetic brush assembly 3 including a sleeve 4 made of non-magnetic material and a permanent magnet assembly 5 is same as that of the previous embodiment. During the developing operation the sleeve 4 is rotated by means of a gear 23 and a shaft 21 which is connected to the sleeve, while the magnet assembly 5 is made stationary by means of a locking mechanism which will be explained hereinafter. Whereas during the discharging operation for a fatigued developing agent the magnet assembly 5 is manually rotated and the sleeve is also rotated due to a magnetic force produced between the magnet and the magnetic carriers and a frictional force caused between the sleeve surface and carriers.

As illustrated in FIG. 8, a shaft 5*a* is connected to one side of the magnet assembly 5 and extends outwardly beyond a holding plate 26 integrally with which is formed a substantially cup-like member 34. When the developing device is pulled out of a main body of the copying machine in a direction d, an operator can grasp the cup-like member 34. A handle holding member 35 is secured to a free end of the shaft 5*a* which supports a lever-like handle 36 having a pin 37 secured at its free end. As best shown in FIG. 9, the handle 36 is rotatably secured to the holding member 35 by means of a shaft 38 and a coiled spring 39 is arranged between the handle 36 and the holding member 35 so as to bias the handle to rotate in the anti-clockwise direction in FIG. 8. In order to lock the magnet assembly 5 at a given position the cup-like member 34 has formed therein a recess 34*a* in which the handle 36 can be installed. The handle 36 has such a length that it can engage with side walls of the cup-like member 34 defining the recess 34*a*. Therefore, the shaft 5*a* and thus the magnet assembly 5 does not rotate relative to the housing 6 when the handle 36 is installed in the recess 34*a*.

FIG. 10 shows the developing device 2 pulled out of the main body of the copying machine. When the developing device is to be withdrawn from the main body, a cover 40 is first opened. Then, the developing device 2 is pulled in the direction d along guide members 41 and 42 on which edges 43 and 44 formed at a bottom of the housing 6 can slide. After the developing device 2 has been withdrawn to a given extent as shown in FIG. 10, a scraping plate 30 is secured to the housing 6 by means of an engagement of holes 31*a* and 31*b* with heads of screws 9 for fixing a doctor blade to the housing 6 as explained hereinbefore. A box 32 for collecting the developing agent has been placed on an inner wall of the cover 40 before the developing device 2 is withdrawn from the main body. To this end, the cover 40 is formed in such a manner that it can be held horizontally. Further, on the inner wall of the cover is formed a rib 45 for positioning the box 32. In this embodiment, the box 32 also serves as a supporting member for the withdrawn developing device 2.

Then, the handle 36 is pulled out of the recess 34*a* of the cup-like member 34 and is rotated manually in a direction $\overline{b}$ with the aid of the pin 37 which is then extending outwardly. The rotational direction $\overline{b}$ of the handle 36 may be marked on the handle 36. In this manner, the magnet assembly 5 can be rotated in the direction $\overline{b}$ and then the sleeve 4 is also rotated in the direction $\overline{b}$ by a frictional force caused between the sleeve surface and magnetic carriers which are attracted onto sleeve surface due to the magnetic force caused by the magnet assembly. Then, the carriers and toners are transported on the sleeve surface also in the direction b and are scraped off the sleeve by the edge of scraping plate 30. The developing agent thus scraped is collected in the box 32. After the discharging operation has been finished the handle 36 may be stopped at an arbitrary angular position. Then the handle is turned about the shaft 38 and is urged against the outer surface of the cup-like member 34 by means of a resilient force of the coiled spring 39. After a new developing agent has been inserted into the housing 6 through an opening of the housing 6, while the lid 17 being opened, the developing device 2 is pushed into the main body of copying machine along the guide members 41 and 42. When the developing device is installed into a given position, a gear 23 shown in FIG. 8 is engaged with a driving mechanism. When the developing operation is started, a shaft 21 and thus the sleeve 4 are rotated in the direction b and the magnet assembly 5 is also rotated in the same direction b. Therefore, the handle 36 is automatically fitted into the recess 34*a* within a first rotation of the magnet assembly 5. In this manner, the magnet assembly 5 can be locked at the given position with respect to the housing 6.

The present invention is not limited to the embodiments explained above, but many modifications can be conceived within the scope of the invention.

In the above embodiments, the developing agent collecting box 30 is used as the member for supporting the developing device 2 which has been pulled out of the main body of copying machine. But, it is not necessary to do so. For instance, the withdrawn developing device 2 may be supported exclusively by the guide members 41 and 42 or by a supporting member provided on the inner wall of the cover 40. In such a case, it is not necessary to use the rigid box 32.

Figure 11:
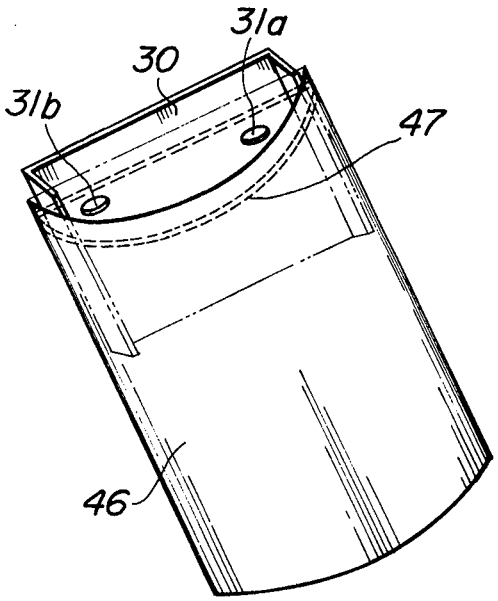
FIGS. 11, 12 and 13 are perspective views showing three embodiments of receptacle means for collecting a discharged developing agent according to the invention.
Figure 12:
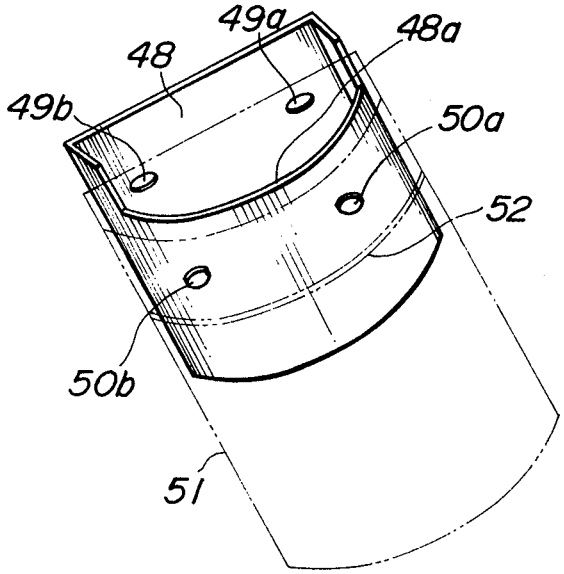
Figure 13:
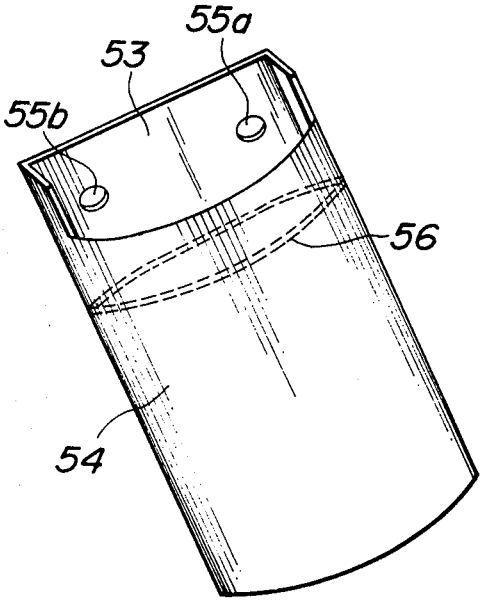

FIGS. 11, 12 and 13 illustrate three embodiments of a bag for collecting the discharged developing agent. In an embodiment shown in FIG. 11, a scraping plate 30 having a pair of holes 31*a* and 31*b* formed therein is secured to the housing 6 of the developing device 2 together with a bag 46 which may be formed by a soft sheet of synthetic material such as a vinyl sheet. The bag 46 has formed therein a pair of holes corresponding to the holes 31*a* and 31*b*. When the scraping plate 30 and bag 46 are secured to the housing 6, the plate 30 is inserted into the bag 46 in such a manner that the holes in the bag 46 are aligned with the holes 31*a* and 31*b* in the scraping plate 30. After the discharged developing agent has been collected in the bag 46, the bag 46 is removed from the housing 6 together with the scraping plate 30 and then the plate is removed from the bag 46. Then, an opening of the bag is closed along a fastener 47 of a groove type by simply pressing upper and lower sheets of the bag 46 against each other.

FIG. 12 illustrates a modification of the assembly of a scraping member and a bag. In this embodiment, a scraping plate 48 comprises a bridge portion 48*a* so as to form a substantially tubular body and has formed therein a pair of holes 49*a* and 49*b* in the plate 48 for engaging with the screws 9 of the developing device 2 and a pair of projections 50*a* and 50*b* on the bridge portion 48*a* for engaging with corresponding holes formed in a bag 51 shown by a dot and chain line. In this manner, the bag 51 can be firmly secured to the scraping member. The bag 51 has formed therein near its opening a fastener 52 of a groove type.

FIG. 13 shows still another embodiment in which a scraping member 53 and a bag 54 are formed integrally with each other. The scraping member 53 is provided with a pair of holes 55*a* and 55*b* for securing it to the housing 6 of the developing device. The bag 54 is formed therein a fastener 56 of a groove type. In this embodiment, after the developing agent is introduced into the bag 54, the whole assembly 53 and 54 may be discharged. Therefore, the operation is much simpler than the previous embodiments.

Further, in the above explained embodiments, the sleeve 4 or the magnet assembly 5 is made rotatable due to the magnetic force caused between the magnetic carriers and the magnet. However, it is also possible to provide a one-way clutch between the sleeve and the magnet assembly. Then, the sleeve and magnet assembly can be simultaneously rotated in a positive manner during the operation for discharging the developing agent.

In the above embodiments, use is made of the two component developing agent consisting of the magnetic carriers and toner particles, but use may be made of a single component developing agent.

As explained above, according to the invention, since the non-magnetic sleeve and the magnet assembly are simultaneously rotated during the operation for discharging the developing agent, the developing agent can be positively and effectively transported on the sleeve to the scraping position and thus almost all developing agent can be discharged within a relatively short time. Further, since there is provided the locking means for positioning the magnet assembly at a given position the magnet assembly can be automatically set in position after the discharging operation.

What is claimed is:

1. An apparatus for discharging a used and fatigued dry developing agent in a magnetic brush developing device for use in an electrophotographic copying machine which developing device comprises a housing forming a reservoir for the developing agent and having an opening formed therein at a position which is opposed to a charge retentive member, for retaining an electrostatic charge image to be developed; a sleeve formed of non-magnetic material arranged in the housing at a position whereby it is exposed to the charge retentive member through the opening and a magnet assembly arranged inside the sleeve; said sleeve and magnet assembly being rotatably arranged about an axis in a given direction, comprising: means for removably supporting the developing device along a direction of said axis from a first developing position in the copying machine at which the developing device develops the charge image on the charge retentive member, to a second discharging position out of the copying machine at which the developing device can be accessed; means for manually rotating the sleeve and magnet assembly together with each other, for transporting the developing agent attracted on the sleeve surface to the opening, when the developing device is in a second discharging position; and scraping means detachably securable to the housing at said opening, while the developing device is in said second discharging position, said scraping means having an edge in contact with the sleeve surface through the opening, so as to scrap the transported developing agent off the sleeve enabling discharge of the developing agent through the opening.

2. An apparatus according to claim 1, wherein said manually rotating means comprises first and second shafts arranged coaxially with the sleeve and connected to respective sides of the magnet assembly, a third shaft arranged coaxially with the sleeve and connected to the sleeve at its one side which faces to the side of the magnet assembly to which said first shaft is secured, said second and third shafts being rotatably journaled to the housing of developing device, a first bearing member arranged between the first shaft and the sleeve, a second bearing member arranged between the second shaft and the sleeve and a manually operable member connected to one of said second and third shafts for rotating manually one of the magnet assembly and the sleeve, while the other of the sleeve and the magnet assembly is made rotatable due to a magnetic force caused between the magnet assembly and magnetic particles in the developing agent as well as a frictional force between the developing agent and the sleeve surface.

3. An apparatus according to claim 2, wherein: said manually rotating means further comprises a mechanism arranged between said second shaft and the housing of the developing device for automatically locking the magnet assembly into a given rotational position, when the developing device is in said first developing position.

4. An apparatus according to claim 3, wherein said locking mechanism comprises a ratchet secured to said second shaft and having formed therein a recess at a given position with respect to the magnet assembly and a claw rotatably secured to the housing of the developing device and biased toward the ratchet in such a manner that the claw can engage with said recess of the ratchet, and said ratchet and claw are so constructed that ratchet can rotate freely in one direction, but cannot rotate in the opposite direction after the claw has been engaged with the recess of the ratchet.

5. An apparatus according to claim 3, wherein said locking mechanism comprises a cup-like member secured to the housing of the developing device coaxially with said second shaft and having formed therein a recess extending radially, a lever-like handle journaled to said second shaft rotatably in a plane including the second shaft and having a first position in which the handle is inserted into the recess of cup-like member and a second position in which the handle is pulled out of the recess, and a spring member arranged between the handle and the second shaft for biasing the handle to rotate into said first position.

6. An apparatus according to claim 1, wherein when the developing device is in said second discharging position, the sleeve and the magnet assembly are rotated in such a direction that a magnetic brush formed on the sleeve surface rotates in a direction opposite to that of the magnetic brush when the developing device is in said first developing position.

7. An apparatus according to claim 1, wherein said scraping means comprises a channel-like plate having a scraping edge and holes for engaging with projections formed on the housing of the developing device to secure detachably the plate to the housing.

8. An apparatus according to claim 7, further comprising receptacle means arranged below the scraping means for receiving the discharged developing agent through the opening.

9. An apparatus according to claim 8, wherein said receptacle means is a box.

10. An apparatus according to claim 9, further comprising: a cover rotatably journaled to a main body of the copying machine for closing an opening formed in said main body through which the developing device can be moved from the first developing position to the second discharging position and vice versa, and a rib provided on an inner surface of the cover, which rib serves to position the box, when the cover is fully opened.

11. An apparatus according to claim 10, wherein said box has such a height that the developing device pulled out of the main body can be rest upon an upper edge of the box.

12. An apparatus according to claim 8, wherein said receptacle means is defined by a bag formed of a soft sheet, which bag is provided with holes corresponding to said holes formed in the channel-like plate and a fastener of a groove type formed near an opening of the bag.

13. An apparatus according to claim 12, wherein said channel-like plate further comprises a bridge and projections formed on an outer surface of the bridge, and said bag further comprises holes corresponding to said projections.

* * * * *

UNITED STATES PATENT AND TRADEMARK OFFICE

CERTIFICATE OF CORRECTION

PATENT NO. : 4,271,784

DATED : June 8, 1981

INVENTOR(S) : ISHIMOTO et al

It is certified that error appears in the above—identified patent and that said Letters Patent is hereby corrected as shown below:

On title page please insert

--[30] Foreign Application Priority Data

Sept. 9, 1978 [JP] . . . . 111,145/78
Feb. 1, 1979 [JP]. . . . . 10,914/79--

Signed and Sealed this

*Twenty-second* Day of *June 1982*

[SEAL]

*Attest:*

GERALD J. MOSSINGHOFF

*Attesting Officer*

*Commissioner of Patents and Trademarks*